US007593540B2

(12) United States Patent
Itakura

(10) Patent No.: US 7,593,540 B2
(45) Date of Patent: Sep. 22, 2009

(54) ELECTROACOUSTIC TRANSDUCER AND MAGNETIC CIRCUIT UNIT

(75) Inventor: Toshio Itakura, Tsuru (JP)

(73) Assignee: Citizen Electronics Co., Ltd, Yamanashi-Ken (JP)

( * ) Notice: Subject to any disclaimer, the term of this patent is extended or adjusted under 35 U.S.C. 154(b) by 0 days.

(21) Appl. No.: 12/139,109

(22) Filed: Jun. 13, 2008

(65) Prior Publication Data

US 2008/0309440 A1 Dec. 18, 2008

(30) Foreign Application Priority Data

Jun. 15, 2007 (JP) ..... 2007-159419

(51) Int. Cl.
*H01F 7/02* (2006.01)
*H04R 9/06* (2006.01)

(52) U.S. Cl. ..... 381/412; 381/420; 381/421; 335/222; 335/296; 335/306

(58) Field of Classification Search ..... 381/412, 381/420–422; 335/296, 297, 306, 222
See application file for complete search history.

(56) References Cited

U.S. PATENT DOCUMENTS 4,679,022 A * 7/1987 Miyamoto et al. ..... 335/296
2007/0165902 A1 * 7/2007 Matsumura et al. ..... 381/396

FOREIGN PATENT DOCUMENTS

JP 58-599 U 1/1983
JP 2002-27590 A 1/2002
JP 2004-356833 A 12/2004
WO WO 2006080405 A1 * 8/2006

* cited by examiner

*Primary Examiner*—Ramon M Barrera
(74) *Attorney, Agent, or Firm*—Brinks Hofer Gilson & Lione

(57) ABSTRACT

An electroacoustic transducer has a magnetic circuit unit including a plate-shaped yoke, first and second magnets juxtaposed on the yoke, and first and second top plates mounted on the respective tops of the first and second magnets. One end of the first magnet is magnetized to one of north and south poles. The other end of the first magnet is opposite in polarity to the one end. The second magnet is magnetized to polarities opposite to those of the first magnet. A magnetic gap is formed between the first and second top plates.

12 Claims, 8 Drawing Sheets

[Fig. 1a]
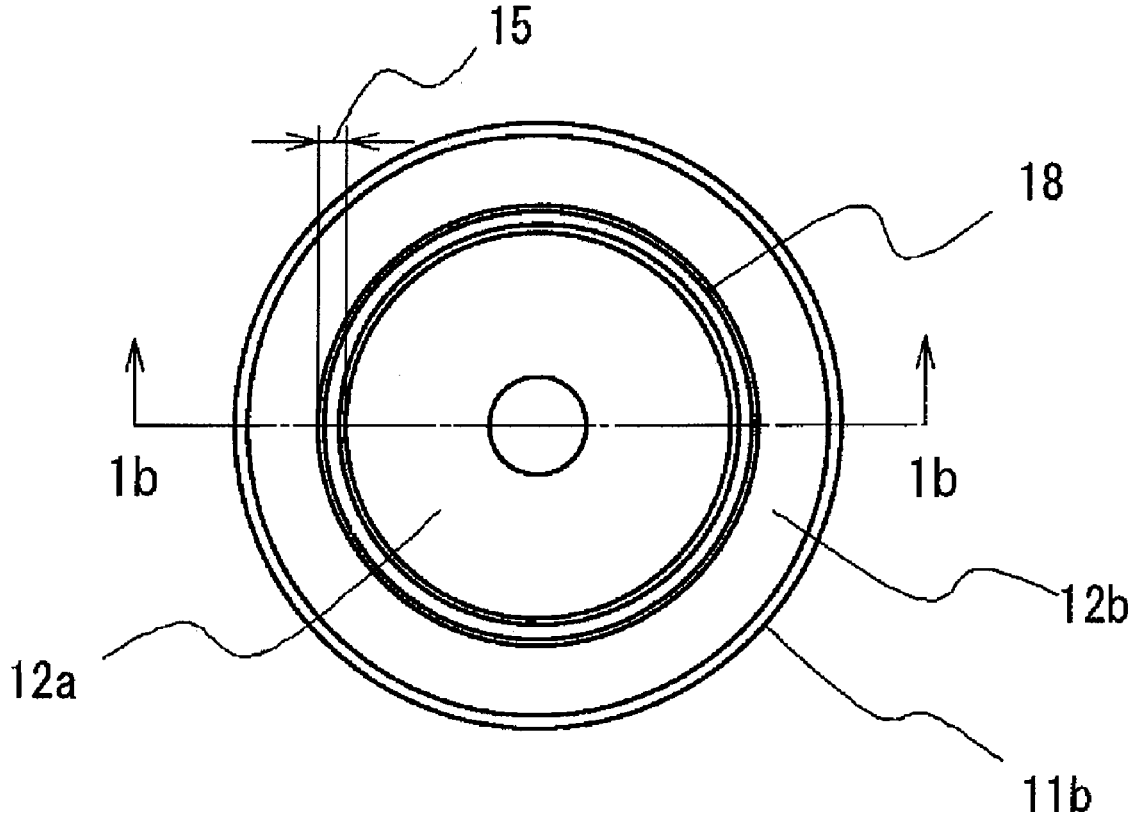
[Fig. 1b]
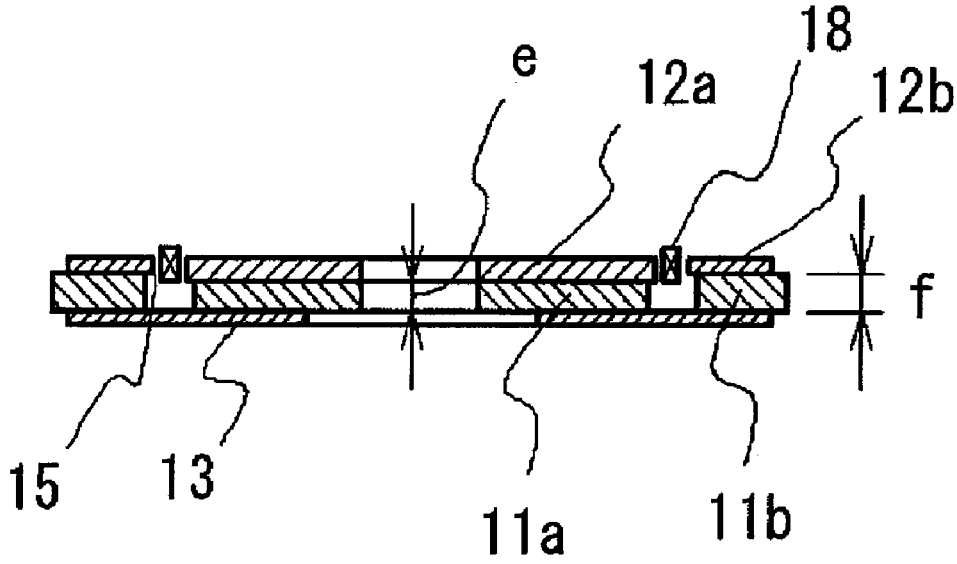

[Fig. 2]
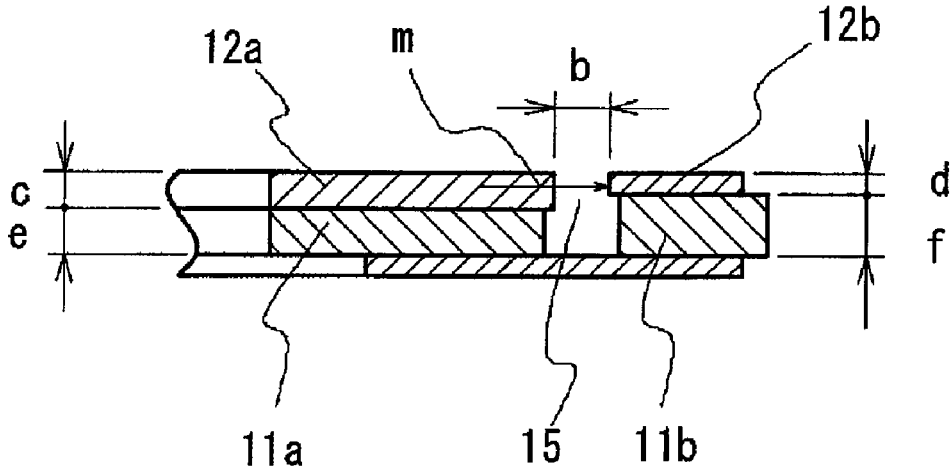

[Fig. 3a]
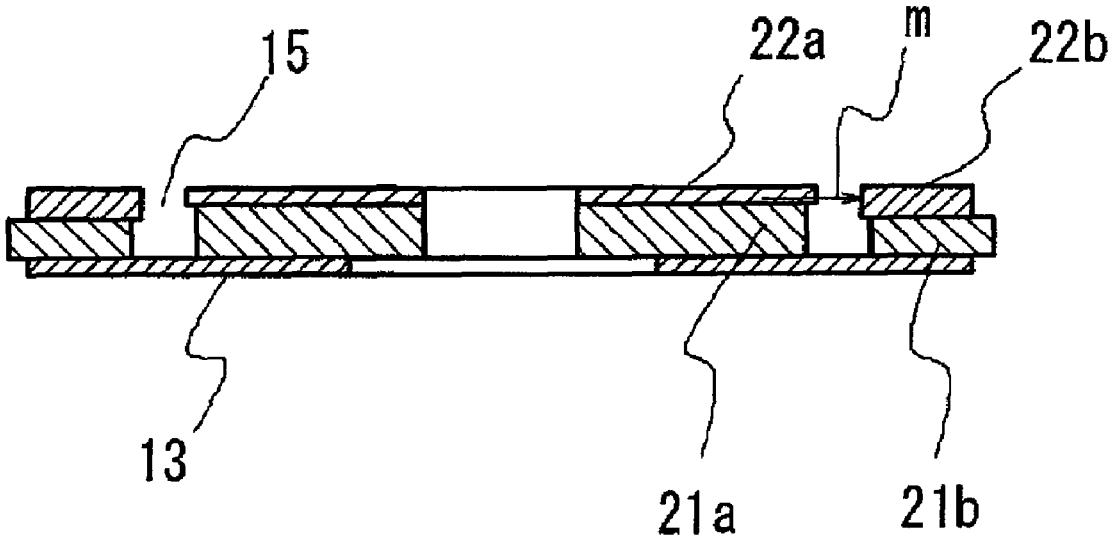
[Fig. 3b]
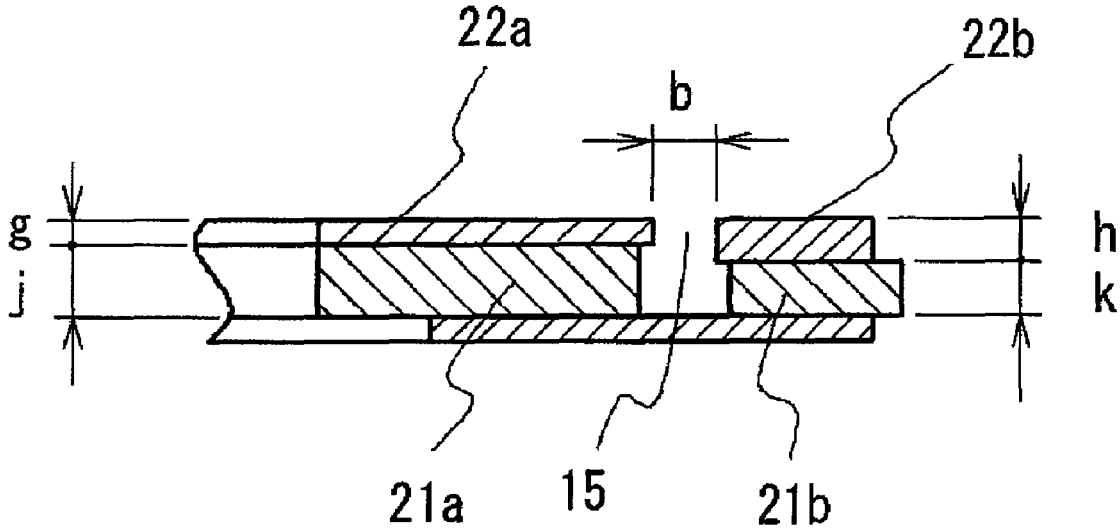

[Fig. 4a]
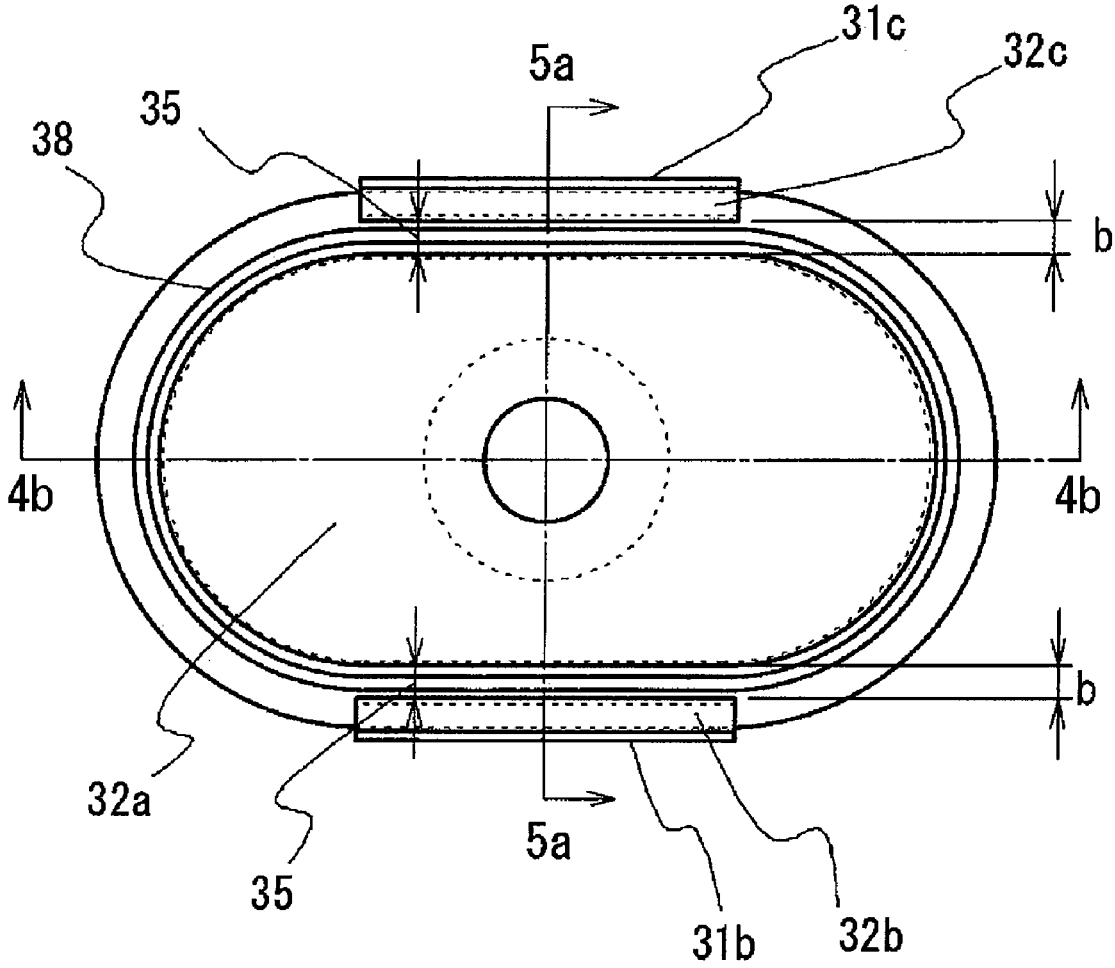
[Fig. 4b]
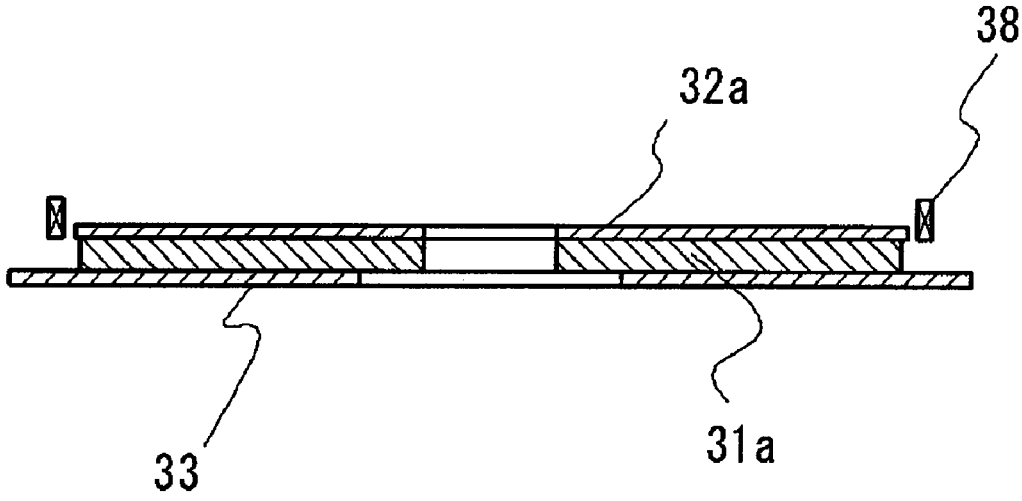

[Fig. 5a]
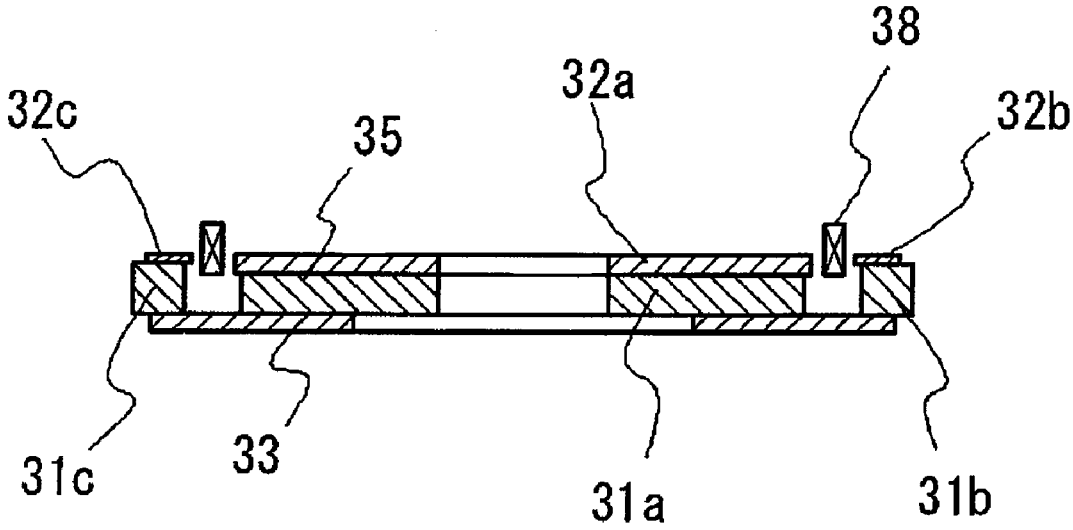
[Fig. 5b]
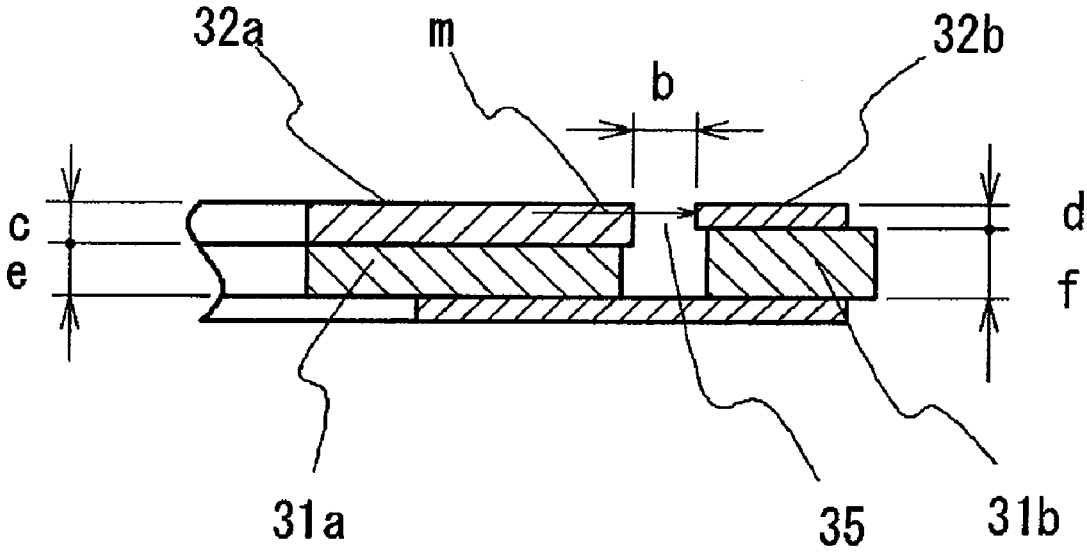

[Fig. 6a]
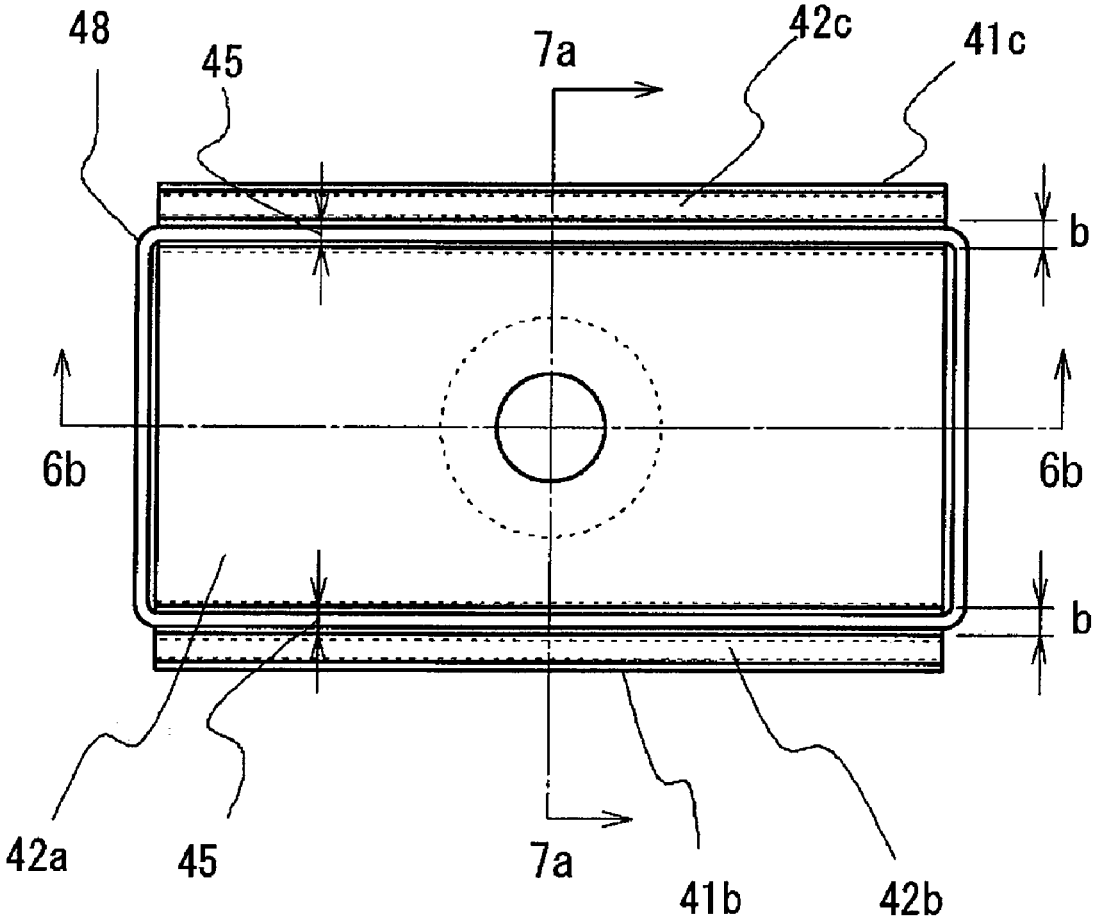
[Fig. 6b]
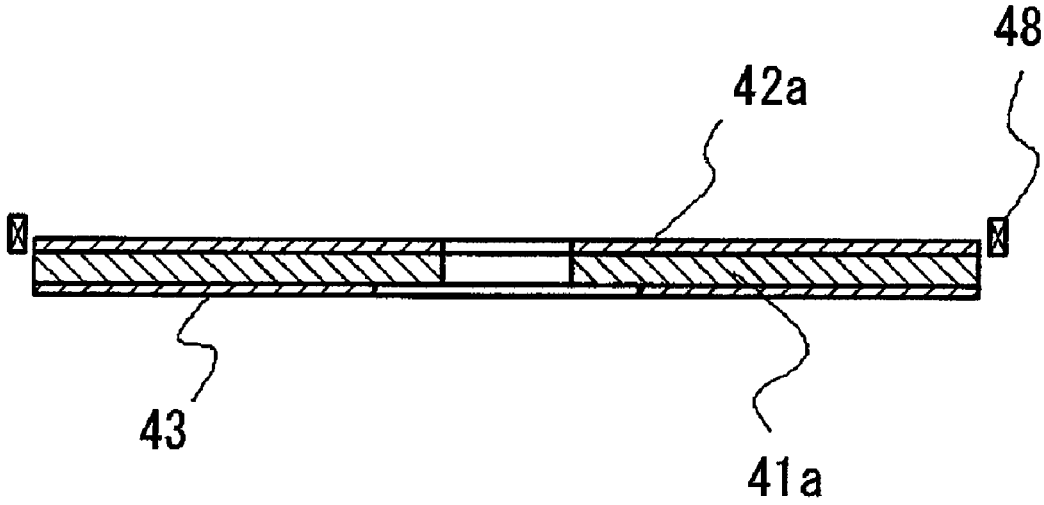

[Fig. 7a]
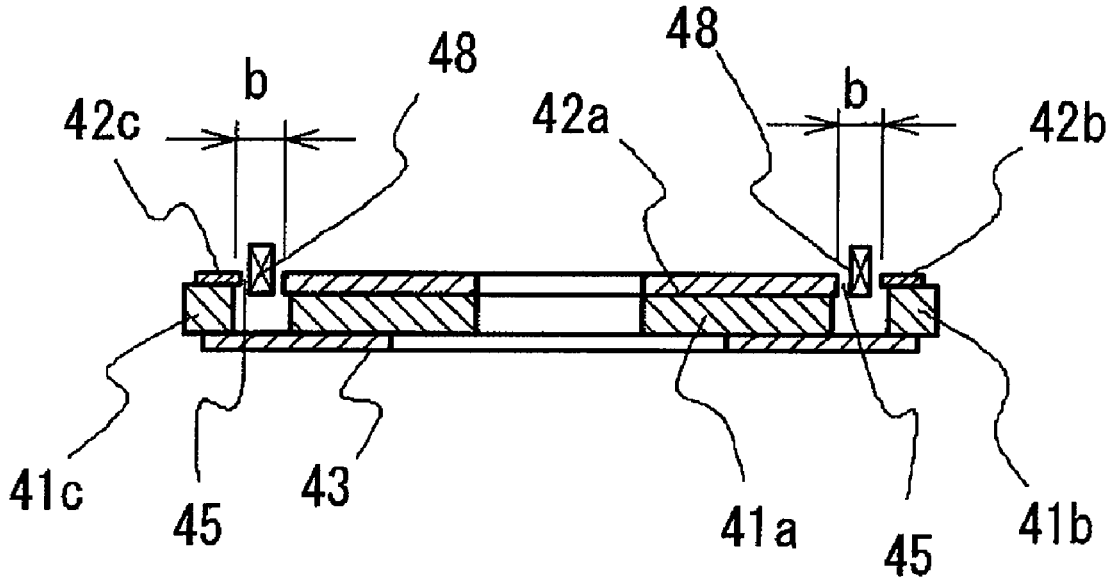
[Fig. 7b]
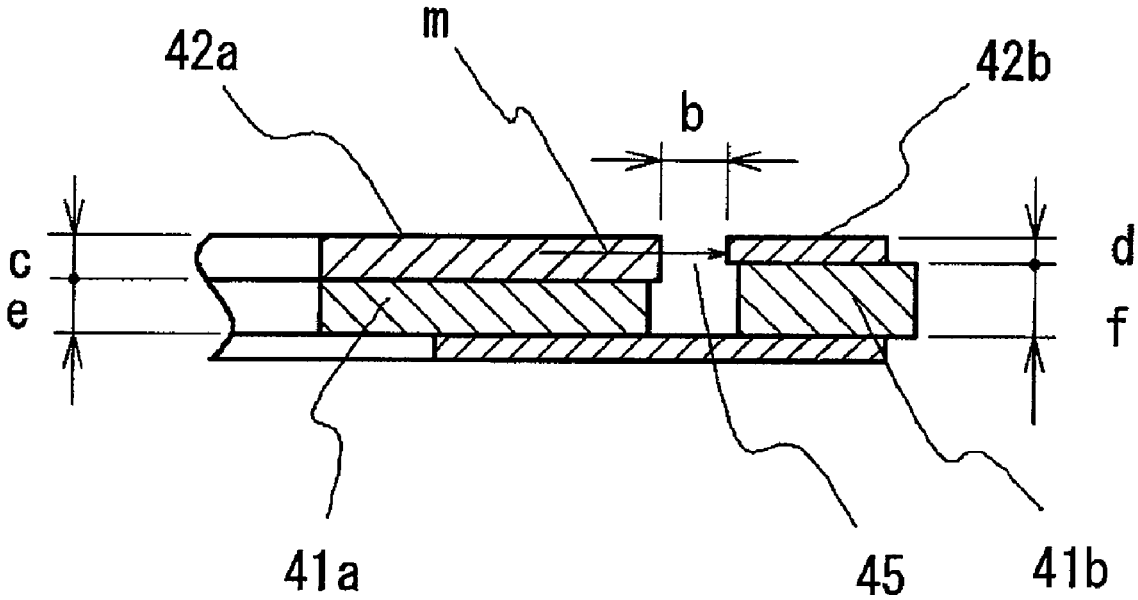

[Fig. 8a]
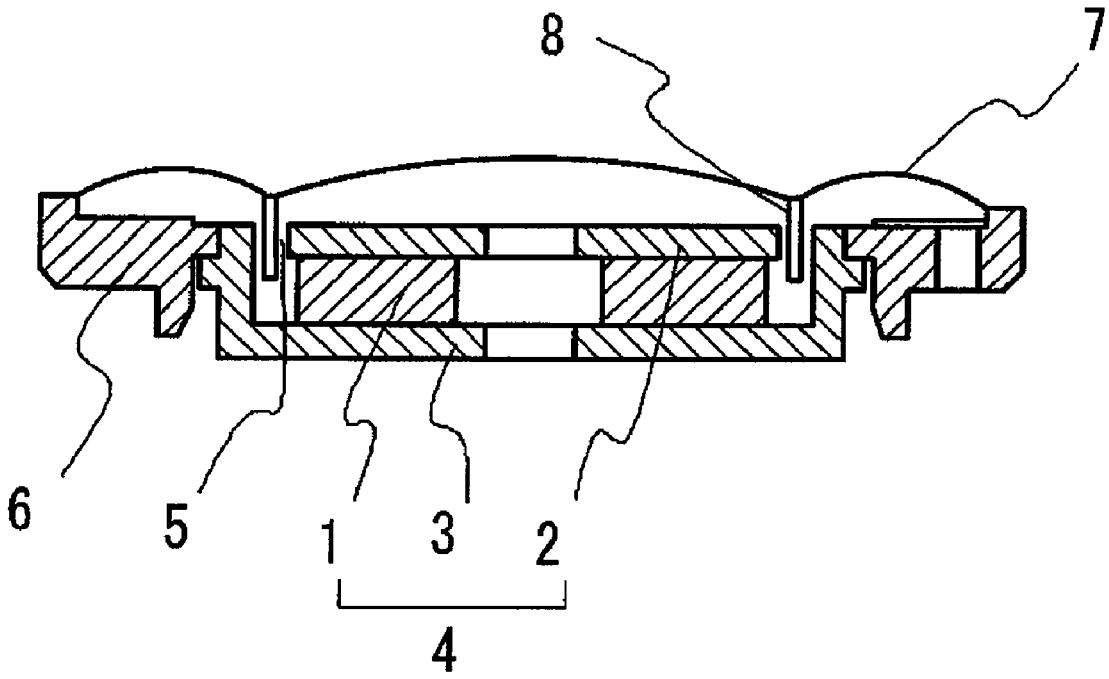
[Fig. 8b]
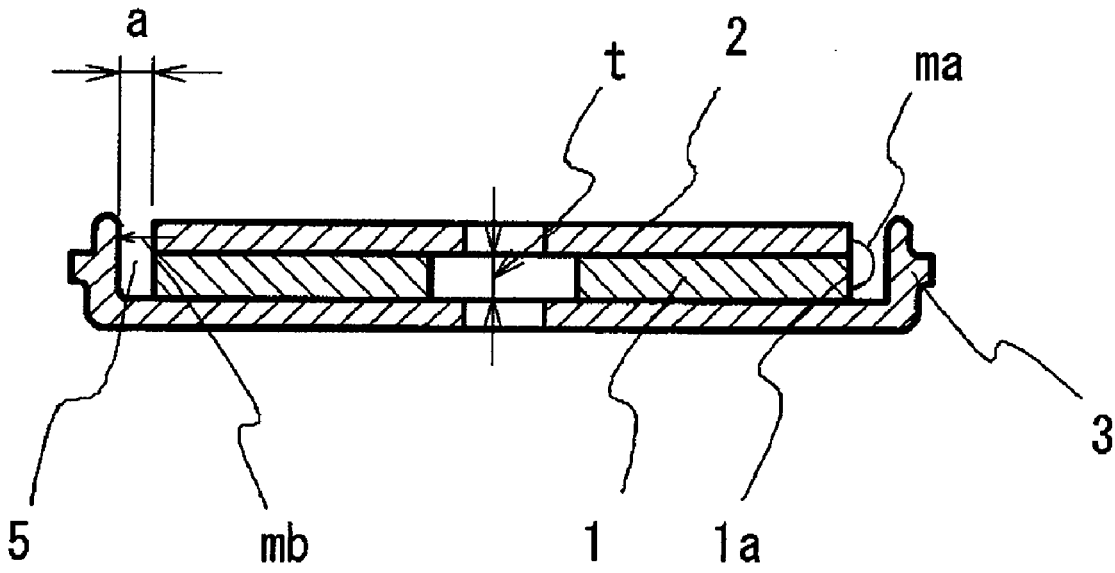

ELECTROACOUSTIC TRANSDUCER AND MAGNETIC CIRCUIT UNIT

This application claims priority under 35 U.S.C. §119 to Japanese Patent application No. JP2007-159419 filed on Jun. 15, 2007, the entire contents of which are hereby incorporated by reference.

TECHNICAL FIELD

The present invention relates to an electroacoustic transducer for use in acoustic devices and information communication devices, and also relates to a magnetic circuit unit usable in such an electroacoustic transducer.

RELATED ART

Recently, small, thin and high-performance electrodynamic speakers have been widely used as electroacoustic transducers of mobile communication devices such as mobile phones (for example, see Japanese Patent Application Publication No. 2004-356833). FIGS. 8*a* and 8*b* show one example of such conventional speakers.

As shown in FIGS. 8*a* and 8*b*, a conventional speaker has a magnetized magnet 1, a top plate 2, a yoke 3, a frame 6 bonded to the yoke 3, a diaphragm 7 bonded to the peripheral edge of the frame 6, and a voice coil 8 bonded to an underside of the diaphragm 7. The magnet 1, the top plate 2 and the yoke 3 constitute in combination a magnetic circuit unit 4. The voice coil 8 is inserted into a magnetic gap 5 in the magnetic circuit unit 4. When a sound signal is input to the voice coil 8 of the speaker, the voice coil 8 vibrates, causing the diaphragm 7 to vibrate and generate sound.

The magnetic circuit unit 4 of the speaker according to the conventional art has a structure in which the magnet 1 is stacked on a top of the yoke 3 and the top plate 2 is stacked on a top of the magnet 1, as has been stated above. Accordingly, it is necessary in order to achieve a thinner profile to reduce the thickness of each component of the magnetic circuit unit 4. However, if the thickness t of the magnet 1 is set smaller than the value a of the magnetic gap 5 in the magnetic circuit unit 4, a magnetic path is formed along which the magnetic flux ma flows directly to an end surface 1*a* of the magnet 1, resulting in a reduction of magnetic flux mb in the magnetic gap 5. Thus, it has been difficult to reduce the thickness of the electroacoustic transducer.

SUMMARY OF THE INVENTION

The present invention has been made in view of the above-described problem. Accordingly, an object of the present invention is to provide an electroacoustic transducer that is capable of keeping a desired magnetic flux in the magnetic gap even if the thickness t of the magnet is set smaller than the value a of the magnetic gap, and that is hence thin and superior in acoustic characteristics. Another object of the present invention is to provide a magnetic circuit unit that allows implementation of such an electroacoustic transducer.

That is, the present invention provides a magnetic circuit unit including a first magnet, a second magnet, a yoke, a first top plate, and a second top plate. The first magnet has one end magnetized to one of north and south poles. An other end of the first magnet is magnetized to be opposite in polarity to the one end of the first magnet. The second magnet is juxtaposed to and spaced apart from the first magnet. The second magnet has one end and an other end that correspond to the one end and the other end, respectively, of the first magnet. The one end and the other end of the second magnet are magnetized to be opposite in polarity to the one end and the other end, respectively, of the first magnet. The yoke mounts the first and second magnets thereon and magnetically couples together the one end of the first magnet and the one end of the second magnet. The first top plate is mounted on and magnetically coupled to the other end of the first magnet. The second top plate is mounted on and magnetically coupled to the other end of the second magnet with the second top plate spaced apart from the first top plate. A magnetic gap is formed between the first and second top plates.

Specifically, the thickness of each of the first and second magnets between the one end and the other end thereof is smaller than the width of the magnetic gap.

With the above-described arrangement, it is possible to reduce the thickness of the magnetic circuit unit while maintaining the desired acoustic characteristics.

More specifically, the magnetic circuit unit may be arranged as follows. The first and second top plates have respective peripheral edge surfaces facing each other across the magnetic gap. The peripheral edge surface of the first top plate is flush with the peripheral edge surface of the first magnet that faces the second magnet, or positioned closer to the second top plate than the peripheral edge surface of the first magnet that faces the second magnet. The peripheral edge surface of the second top plate is flush with the peripheral edge surface of the second magnet that faces the first magnet, or positioned closer to the first top plate than the peripheral edge surface of the second magnet that faces the first magnet.

The arrangement may be such that the second magnet is an annular member surrounding the first magnet, and the second top plate is an annular member surrounding the first top plate.

As a modification of the above-described arrangement, the second magnet may be formed to extend along a part of the peripheral edge of the first magnet. The second magnet may be a rectangular parallelepiped magnet, for example, which is rectangular in top plan view.

More specifically, the magnetic circuit unit may be arranged as follows. The yoke has a plane surface fixedly engaged with the one end of the first magnet and the one end of the second magnet. The thickness of the first magnet between the one end and the other end thereof and the thickness of the second magnet between the one end and the other end thereof are different from each other. The first and second top plates are mounted on and fixedly engaged with the other ends of the first and second magnets, respectively. The total of the thickness of the first magnet and the thickness of the first top plate is substantially equal to the total of the thickness of the second magnet and the thickness of the second top plate.

In consequence of the above-described arrangement, one of the first and second top plates, which form the magnetic gap, becomes thick in thickness, and the other top plate becomes thin. This enables the magnetic flux density to increase and hence makes it possible to improve acoustic characteristics.

Embodiments of the present invention will be explained below with reference to the accompanying drawings.

BRIEF DESCRIPTION OF THE DRAWINGS

FIG. 1*a* is a plan view of a main part of a speaker according to a first embodiment of the present invention.

FIG. 1*b* is a sectional view taken along the line 1*b*-1*b* in FIG. 1*a*.

FIG. 2 is an enlarged sectional view of a part of the speaker shown in FIG. 1*b*.

FIG. 3*a* is a sectional view showing a modification of the speaker according to the first embodiment of the present invention.

FIG. 3*b* is an enlarged sectional view of a part of the speaker shown in FIG. 3*a*.

FIG. 4*a* is a plan view of a main part of a speaker according to a second embodiment of the present invention.

FIG. 4*b* is a sectional view taken along the line 4*b*-4*b* in FIG. 4*a*.

FIG. 5*a* is a sectional view taken along the line 5*a*-5*a* in FIG. 4*a*.

FIG. 5*b* is an enlarged sectional view of a part of the speaker shown in FIG. 5*a*.

FIG. 6*a* is a plan view of a main part of a speaker according to a third embodiment of the present invention.

FIG. 6*b* is a sectional view taken along the line 6*b*-6*b* in FIG. 6*a*.

FIG. 7*a* is a sectional view taken along the line 7*a*-7*a* in FIG. 6*a*.

FIG. 7*b* is an enlarged sectional view of a part of the speaker shown in FIG. 7*a*.

FIG. 8*a* is a sectional view of a speaker according to a conventional art.

FIG. 8*b* is sectional view of a main part of the speaker shown in FIG. 8*a*.

DETAILED DESCRIPTION OF THE PREFERRED EMBODIMENTS

First Embodiment

FIGS. 1*a*, 1*b* and 2 show a magnetic circuit unit as a main part of a speaker according to a first embodiment of the present invention. The magnetic circuit unit of the speaker includes a disk-shaped yoke 13 having an opening in the center thereof. The magnetic circuit unit further includes first and second annular magnets 11*a* and 11*b* and first and second top plates 12*a* and 12*b*. The first annular magnet 11*a* is coaxially disposed on the yoke 13. The second annular magnet 11*b* is coaxially disposed on the yoke 13 around the first magnet 11*a* with a predetermined spacing therebetween. The first top plate 12*a* is coaxially disposed on a top of the first magnet 11*a*. The second top plate 12*b* is coaxially disposed on a top of the second magnet 11*b*.

The first magnet 11*a* has one surface magnetized to a north pole and the other surface to a south pole. The first top plate 12*a* is an annular magnetic member which is larger than the first magnet 11*a* in outline.

The second magnet 11*b* has one surface magnetized to a south pole and the other surface to a north pole, and the first and second magnets 11*a* and 11*b* are opposite in polarity to each other. The second top plate 12*b* disposed on the top of the second magnet 11*b* is an annular magnetic member having an opening smaller than that of the second magnet 11*b* in diameter.

The thickness f of the second magnet 11*b* is set larger than the thickness e of the first magnet 11*a*. The thickness d of the second top plate 12*b* is set smaller than the thickness c of the first top plate 12*a*. When the first and second top plates 12*a* and 12*b* are stacked on the first and second magnets 11*a* and 11*b*, respectively, with this arrangement, the respective tops of the first and second top plates 12*a* and 12*b* are substantially flush with each other.

A magnetic gap 15 is formed between the outer periphery of the first top plate 12*a* and the inner periphery of the second top plate 12*b*. The magnetic gap 15 has an air gap distance b. The thicknesses e and f of the first and second magnets 11*a* and 11*b* are each set smaller than the air gap distance b of the magnetic gap 15. With the arrangement in which the second magnet 11*b* is disposed around the first magnet 11*a* with a predetermined spacing therebetween, a magnetic field of high magnetic flux density m acts on the magnetic gap 15 from the first top plate 12*a* to the second top plate 12*b*. Thus, the magnetic flux density m acting on the air gap of the magnetic gap 15 increases.

The first and second magnets 11*a* and 11*b* may include different materials from each other. In this embodiment, the first magnet 11*a* is a neodymium magnet, and the second magnet 11*b* is a neodymium bond magnet, which is less costly than the neodymium magnet.

Further, as the result of setting the thickness c of the first top plate 12*a* larger than the thickness d of the second top plate 12*b*, an outlet area of the magnetic flux becomes larger than an inlet area of the magnetic flux, which allows the magnetic flux to concentrate even more densely in the magnetic gap 15. Thus, the magnetic flux density m acting on the air gap of the magnetic gap 15 further increases. In this embodiment, it has been confirmed that the magnetic flux density m increases under the following conditions: the air gap distance b of the magnetic gap 15 is 0.55 mm; the thickness e of the first magnet 11*a* is 0.4 mm; the thickness f of the second magnet 11*b* is 0.5 mm; the thickness c of the first top plate 12*a* is 0.3 mm; and the thickness d of the second top plate 12*b* is 0.2 mm. It should be noted, however, that the gap and thickness dimensions are not limited to these numerical values but may be set appropriately.

It has been experimentally confirmed that the magnetic flux density m increases even when the thicknesses c and d of the first and second top plates 12*a* and 12*b* are the same value. However, it is preferable to set the thicknesses c and d of the first and second top plates 12*a* and 12*b* to different values because such a configuration makes that the magnetic flux concentrates even more densely in the magnetic gap 15 and the magnetic flux density m acting on the air gap of the magnetic gap 15 further increases.

A voice coil 18 is inserted into the magnetic gap 15. When an electric current corresponding to a sound signal flows through the voice coil 18, the voice coil 18 is displaced to vibrate a diaphragm (not shown) to which the voice coil 18 is secured. The diaphragm is the same as that in the conventional art. Therefore, an explanation thereof is omitted herein.

Although in this embodiment the magnet and other constituent members are circular in plan view, their configurations are not limited to the circular ones but may be oval, rectangular or other shapes.

FIGS. 3*a* and 3*b* show a modification in which the thickness h of the second top plate 22*b* is set larger than the thickness g of the first top plate 22*a*. From the viewpoint of increasing the magnetic flux density in the magnetic gap, however, the arrangement shown in FIGS. 1*a* to 2 is superior to the modification shown in FIGS. 3*a* and 3*b*.

In the illustrated example, the peripheral edge surfaces of the first and second top plates that face each other across the magnetic gap are set closer to each other than the mutually facing peripheral edge surfaces of the first and second magnets. However, the mutually facing peripheral edge surfaces of the first and second top plates may be set flush with the mutually facing peripheral edge surfaces of the first and second magnets, respectively.

Second Embodiment

FIGS. 4*a*, 4*b*, 5*a* and 5*b* show a magnetic circuit unit as a main part of a speaker according to a second embodiment of the present invention.

As shown in FIGS. 4*a* to 5*b*, the magnetic circuit unit of the speaker according to this embodiment includes an oval yoke 33 having an opening in the center thereof. The magnetic circuit unit further includes an oval first magnet 31*a*, a pair of rectangular second magnets 31*b* and 31*c*, an oval first top plate 32*a*, and a pair of rectangular second top plates 32*b* and 32*c*. The first magnet 31*a* is coaxially disposed on the yoke 33. The second magnets 31*b* and 31*c* are disposed at two sides of the first magnet 31*a* with a spacing from the first magnet 31*a*. The first top plate 32*a* is coaxially disposed on the top of the first magnet 31*a*. The pair of second top plates 32*b* and 32*c* are disposed on the respective tops of the second magnets 31*b* and 31*c*. The second magnets 31*b* and 31*c* have the same shape as each other. The second top plates 32*b* and 32*c* also have the same shape as each other.

The first magnet 31*a* has one surface magnetized to a north pole and the other surface to a south pole. The first top plate 32*a* is an oval magnetic member which is larger than the first magnet 31*a* in outline.

The second magnets 31*b* and 31*c*, each have one surface magnetized to a south pole and the other surface to a north pole, and the second magnets 31*b* and 31*c* are configured to be opposite in polarity to the first magnet 31*a*. The second top plate 32*b* is disposed on the top of the second magnet 31*b* and has an inwardly projected part off the top surface of the second magnet 31*b*, i.e. the former is disposed closer to the center than the latter. Similarly, the other second top plate 32*c* is disposed on the top of the second magnet 31*c* and has an inwardly projected part off the top surface of the second magnet 31*c*, i.e. the former is disposed closer to the center than the latter. The second top plates 32*b* and 32*c* are both magnetic members.

The thickness f of the second magnets 31*b* and 31*c* is set larger than the thickness e of the first magnet 31*a*. The thickness d of the second top plates 32*b* and 32*c* is set smaller than the thickness c of the first top plate 32*a*. When the first and second top plates 32*a*, 32*b* and 32*c* are stacked on the first and second magnets 31*a*, 31*b* and 31*c*, respectively, the respective tops of the first and second top plates 32*a*, 32*b* and 32*c* are substantially flush with each other.

A magnetic gap 35 having an air gap distance b is formed between the outer periphery of the first top plate 32*a* and the inner side surface of the one second top plate 32*b*. Similarly, a magnetic gap 35 having an air gap distance b is formed between the outer periphery of the first top plate 32*a* and the inner side surface of the other second top plate 32*c*. The thicknesses e and f of the first and second magnets 31*a*, 31*b* and 31*c* are each set smaller than the air gap distance b of each magnetic gap 35. With the arrangement in which the second magnets 31*b* and 31*c* are disposed opposite to each other, the second magnets 31*b* and 31*c*, each extending along a part of the periphery of the first magnet 31*a* with a predetermined spacing therebetween, a magnetic field of high magnetic flux density m acts on the one magnetic gap 35 from the first top plate 32*a* to the one second top plate 32*b*. Similarly, a magnetic field of high magnetic flux density m acts on the other magnetic gap 35 from the first top plate 32*a* to the other second top plate 32*c*. Thus, the magnetic flux density m acting on the air gap of each magnetic gap 15 increases.

Further, as the result of setting the thickness c of the first top plate 32*a* larger than the thickness d of the second top plates 32*b* and 32*c*, an outlet area of the magnetic flux becomes larger than an inlet area of the magnetic flux, which allows the magnetic flux to concentrate even more densely in each magnetic gap 35. Thus, the magnetic flux density m acting on the air gap of the magnetic gap 35 further increases.

The second embodiment is the same as the first embodiment in terms of the material and thickness of the first magnet 31*a* and the second top plates 32*b* and 32*c* and in terms of the thickness of the first top plate 32*a* and the second top plates 32*b* and 32*c*. Therefore, a description thereof is omitted herein.

A voice coil 38 is inserted into the magnetic gaps 15. The voice coil 38 is connected to a diaphragm (not shown).

As has been stated above, the magnetic circuit unit according to this embodiment is formed in an oval shape. Therefore, if it is installed in a rectangular device such as a mobile phone, it is possible to increase the magnetic flux density of the magnetic circuit unit and to increase the sound pressure of the speaker. Thus, it is possible to provide a thin electroacoustic transducer excellent in acoustic characteristics. It is also possible in this embodiment to obtain the same advantageous effects as those in the first embodiment.

Third Embodiment

FIGS. 6*a*, 6*b*, 7*a* and 7*b* show a magnetic circuit unit as a main part of a speaker according to a third embodiment of the present invention. This embodiment differs from the second embodiment in that the first magnet is rectangular in top plan view. The arrangement of the rest of this embodiment is substantially the same as that of the second embodiment.

As shown in FIGS. 6*a* to 7*b*, the magnetic circuit unit of the speaker according to this embodiment includes a rectangular yoke 43 having an opening in the center thereof. The magnetic circuit unit further includes a rectangular first magnet 41*a*, a pair of rectangular parallelepiped second magnets 41*b* and 41*c*, a rectangular first top plate 42*a*, and a pair of rectangular second top plates 42*b* and 42*c*. The first magnet 41*a* has an opening in the center thereof and is disposed at the center of the top of the yoke 43. The second magnets 41*b* and 41*c* are rectangular in top plan view and disposed along the long sides, respectively, of the first magnet 41*a* with a predetermined spacing from each side of the first magnet 41*a*. The first top plate 42*a* is disposed on the top of the first magnet 41*a*. The pair of second top plates 42*b* and 42*c* are disposed on the respective tops of the second magnets 41*b* and 41*c*. The second magnets 41*b* and 41*c* have the same shape as each other. The second top plates 42*b* and 42*c* also have the same shape as each other.

The first magnet 41*a* has one surface magnetized to a north pole and the other surface to a south pole. The first top plate 42*a* is a magnetic member that is rectangular in plan view and larger than the first magnet 41*a* in outline.

The second magnets 41*b* and 41*c* are each magnetized to polarities opposite to those of the first magnet 41*a*. The second top plate 42*b* is disposed on the top of the second magnet 41*b* and has an inwardly projected part off the top surface of the second magnet 41*b*, i.e. the former is disposed closer to the center than the latter. Similarly, the other second top plate 42*c* is disposed on the top of the second magnet 41*c* and has an inwardly projected part off the top surface of the second magnet 41*c*, i.e. the former is disposed closer to the center than the latter.

The relationship between the thickness e of the first magnet 41*a* and the thickness f of the second magnets 41*b* and 41*c* and the relationship between the thickness c of the first top plate 42*a* and the thickness d of the second top plates 42*b* and 42*c* are the same as in the second embodiment. Therefore, a description thereof is omitted herein. A magnetic gap 45 having an air gap distance b is formed between the outer periphery of the first top plate 42*a* and the inner side surface of the one second top plate 42*b*. Similarly, a magnetic gap 45 having an air gap distance b is formed between the outer periphery of the first top plate 42*a* and the inner side surface of the other second top plate 42*c*. A voice coil 48 is inserted into the magnetic gaps 45. The relationship between the air gap distance b of each magnetic gap 45, the thicknesses e and f of the first and second magnets 41*a*, 41*b* and 41*c* is also the same as in the second embodiment. Therefore, a description thereof is omitted herein.

With the arrangement in which the second magnets 41*b* and 41*c* are disposed opposite to each other along the long sides, respectively, of the first magnet 41*a* with a predetermined spacing from each side of the first magnet 41*a*, a magnetic field of high magnetic flux density m acts on the one magnetic gap 45 from the first top plate 42*a* to the one second top plate 42*b*. Thus, the magnetic flux density m acting on the air gap of the magnetic gap 45 increases. Similarly, a magnetic field of high magnetic flux density m acts on the other magnetic gap 45 from the first top plate 42*a* to the other second top plate 42*c*. Thus, the magnetic flux density m acting on the air gap of the magnetic gap 45 increases.

Further, as the result of setting the thickness c of the first top plate 42*a* larger than the thickness d of the second top plates 42*b* and 42*c*, an outlet area of the magnetic flux becomes larger than an inlet area of the magnetic flux, which allows the magnetic flux to concentrate even more densely in each magnetic gap 45. Thus, the magnetic flux density m acting on the air gap of the magnetic gap 45 further increases. The arrangement of the rest of this embodiment is the same as the second embodiment. Therefore, a description thereof is omitted herein.

Thus, this embodiment offers the same advantageous effects as obtained in the second embodiment.

In the second and third embodiments, the present invention has been described with regard to a magnetic circuit unit of an oval or rectangular shape in plan view, by way of example. It should be noted, however, that the present invention is not limited to the oval or rectangular magnetic circuit unit but may also be applied to magnetic circuit units having other shapes, e.g. a circular shape in plan view. Although in the foregoing embodiments the present invention has been described with regard to a magnetic circuit unit in which the first magnet and the first top plate each have an opening in the center thereof, the present invention is also applicable to a magnetic circuit unit having no opening.

Although in the foregoing embodiments the present invention has been described with regard to a speaker as an electroacoustic transducer, by way of example, the present invention is not limited to the speaker but may be applied to other electroacoustic transducers such as microphones.

The invention claimed is:

1. A magnetic circuit unit comprising:

a first magnet having one end magnetized to one of a north pole and a south pole and an other end magnetized to be opposite in polarity to the one end of the first magnet;

a second magnet juxtaposed to and spaced apart from the first magnet, the second magnet having one end and an other end that correspond to the one end and the other end, respectively, of the first magnet, the one end and the other end of the second magnet being magnetized to be opposite in polarity to the one end and the other end, respectively, of the first magnet;

a yoke having a plane surface fixedly engaged with the one end of the first magnet and the one end of the second magnet and magnetically coupling together the one end of the first magnet and the one end of the second magnet;

a first top plate mounted on and magnetically coupled to the other end of the first magnet; and a second top plate mounted on and magnetically coupled to the other end of the second magnet with the second top plate spaced apart from the first top plate;

a magnetic gap formed between the first top plate and the second top plate, and a thickness of the first magnet between the one end and the other end thereof and a thickness of the second magnet between the one end and the other end other being smaller than a width of the magnetic gap.

2. The magnetic circuit unit of claim 1, wherein the first top plate and the second top plate have respective peripheral edge surfaces facing each other across the magnetic gap, the peripheral edge surface of the first top plate being positioned closer to the second top plate than a peripheral edge surface of the first magnet that faces the second magnet, the peripheral edge surface of the second top plate being positioned closer to the first top plate than a peripheral edge surface of the second magnet that faces the first magnet.

3. The magnetic circuit unit of claim 1, wherein the first top plate and the second top plate have respective peripheral edge surfaces facing each other across the magnetic gap, and the first magnet and the second magnet have respective peripheral edge surfaces facing each other across the magnetic gap, the peripheral edge surface of the first top plate and the peripheral edge surface of the first magnet being flush with each other, the peripheral edge surface of the second top plate and the peripheral edge surface of the second magnet being flush with each other.

4. The magnetic circuit unit of claim 1, wherein the second magnet is an annular member surrounding the first magnet, and the second top plate is an annular member surrounding the first top plate.

5. The magnetic circuit unit of claim 2, wherein the second magnet is an annular member surrounding the first magnet, and the second top plate is an annular member surrounding the first top plate.

6. The magnetic circuit unit of claim 3, wherein the second magnet is an annular member surrounding the first magnet, and the second top plate is an annular member surrounding the first top plate.

7. The magnetic circuit unit of claim 1, wherein the second magnet is configured to extend along a part of a peripheral edge of the first magnet.

8. The magnetic circuit unit of claim 2, wherein the second magnet is configured to extend along a part of a peripheral edge of the first magnet.

9. The magnetic circuit unit of claim 3, wherein the second magnet is configured to extend along a part of a peripheral edge of the first magnet.

10. The magnetic circuit unit of claim 1, wherein:

the thickness of the first magnet between the one end and the other end thereof and the thickness of the second magnet between the one end and the other end thereof are different from each other;

the first top plate and the second top plate are fixedly engaged with the other end of the first magnet and the other end of the second magnet, respectively; and a total of the thickness of the first magnet and a thickness of the first top plate are substantially equal to a total of the thickness of the second magnet and a thickness of the second top plate.

11. The magnetic circuit unit of claim 10, wherein the thickness of the second top plate is smaller than the thickness of the first top plate.

12. An electroacoustic transducer comprising:

the magnetic circuit unit of claim 1, a voice coil inserted and set in the magnetic gap; and a diaphragm to which the voice coil is connected.

* * * * *